United States Patent [19]

Saino et al.

[11] 4,023,341

[45] May 17, 1977

[54] DEVICE FOR DETECTING THE BREAKAGE OF YARN IN DRAWING FRAMES AND SPINNING FRAMES

[75] Inventors: Emilio Saino; Raffaele Patritti, both of Verbania; Giorgio Toscani, Milan, all of Italy

[73] Assignee: Montefibre, S.p.A., Milan, Italy

[22] Filed: Feb. 10, 1975

[21] Appl. No.: 548,790

[30] Foreign Application Priority Data

Feb. 11, 1974 Italy ..... 20382/74

[52] U.S. Cl. ..... 57/81

[51] Int. Cl.[2] ..... D01H 13/16

[58] Field of Search ..... 57/75, 78, 80, 81

[56] References Cited

UNITED STATES PATENTS

| | | | |
|---|---|---|---|
| 2,922,272 | 1/1960 | Hope | 57/78 |
| 2,930,179 | 3/1960 | Bailey | 57/75 |
| 2,930,180 | 3/1960 | Adams et al. | 57/81 |
| 3,102,378 | 9/1963 | Walker, Jr. | 57/81 |

*Primary Examiner*—John Petrakes

*Attorney, Agent, or Firm*—Stevens, Davis, Miller & Mosher

[57] ABSTRACT

A device is disclosed for detecting yarn breaks in drawing frames and spinning frames comprising a permanent magnet attached to the ring support of the textile machine and an electromagnetic impulse detector also attached to the ring support, close to the path of the traveler which is made at least partially of a ferromagnetic material, said impulse detector being connected, through an amplifier, to a yarn cutting device positioned upstream of the feeding rollers and of the yarn stretching wheel. The electromagnetic impulse detector consists of a coil wound onto a ferromagnetic core.

1 Claim, 1 Drawing Figure

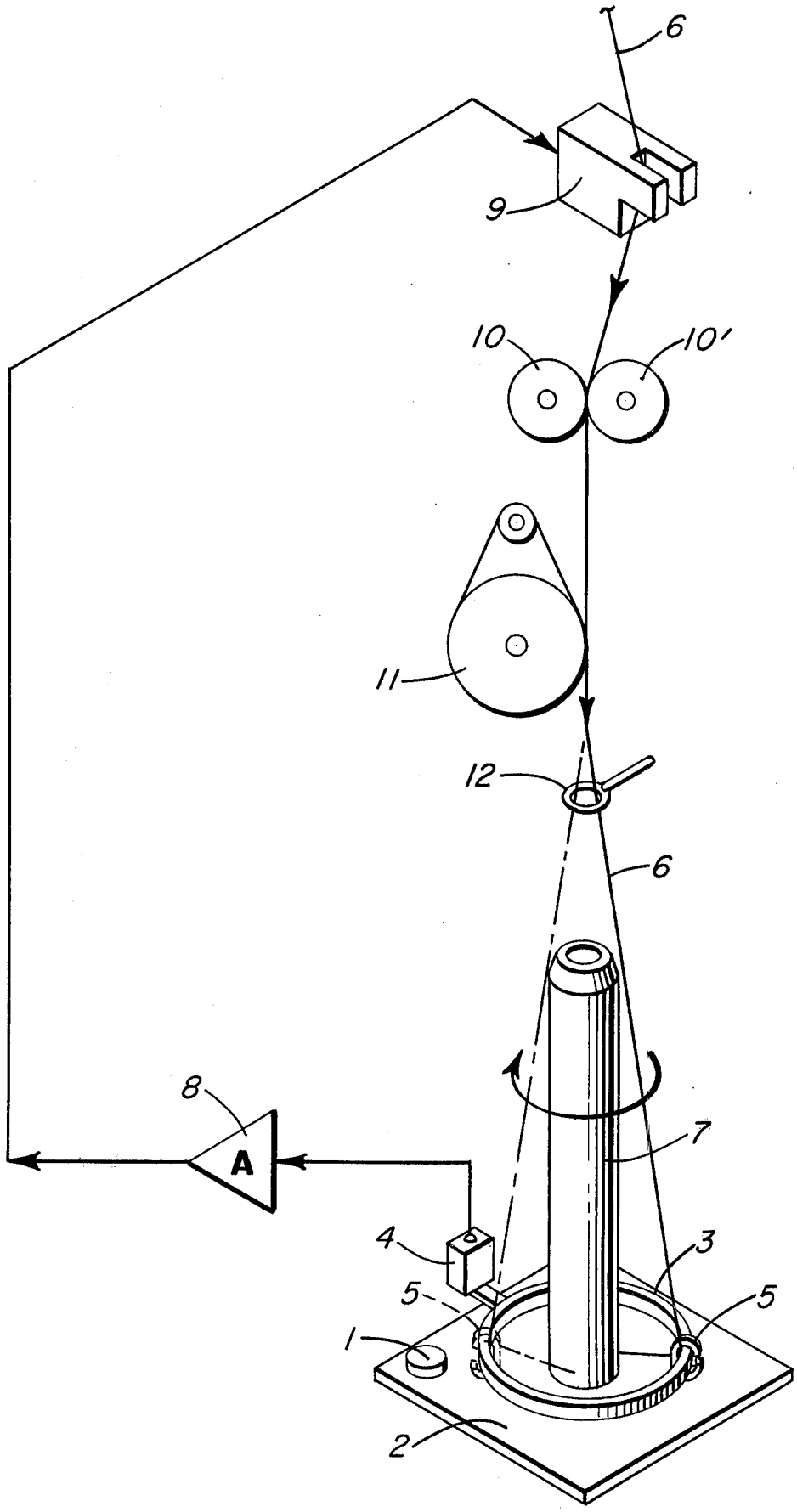
6
9
10
10'
11
12
6
8
A
7
4
3
5
5
1
2

DEVICE FOR DETECTING THE BREAKAGE OF YARN IN DRAWING FRAMES AND SPINNING FRAMES

This invention relates to a device for detecting the breakage of yarn in a drawing frame and spinning frame.

It is well known that in textile machines of the above type the twisted yarn fed by the yarn twisting mechanism is wound at a considerable speed onto a package such as, e.g., a bobbin or a cop, kept rotating by the spindle over which it fits.

In such textile machines which operate at a high speed, difficulties are encountered which depend on the efficient working of a broken yarn detecting device which is generally positioned between the twisting mechanism and the winding mechanism.

The broken yarn detecting device generally used in practice consists of a lever resting on the yarn and kept in its operative detection position by the tension of the yarn itself. When the yarn breaks, the lever falls, thereby actuating means causing the machine to stop.

One drawback of such a device, however, is that ultimately the lever becomes undesirably slack, due to abrasion of the bearing or, more generally, of the supporting means, as a consequence of the vibration to which the lever is subjected during operation.

Moreover, fluff and dust accumulate on the bearing or supporting means of the lever, thus hampering the rotation thereof and reducing its rotation sensibility.

The object of the present invention therefore is to provide a device for detecting yarn breaks in drawing or spinning frames which does not show the above-mentioned drawbacks. A further object of this invention is to provide a device for detecting the passage of the yarn and signaling any break thereof, and suited for use in the above textile machines with winding onto cops and for avoiding the use of any members in contact with the yarn, and consequently not affecting the normal run of the yarn.

These and still further objects which will become apparent from the following description are attained by employing a yarn break detecting device comprising a permanent magnet fixed onto the ring support of the textile machine and an electromagnetic impulse detector also fixed onto the ring support, close to the passage of the traveler which is made at least partially of a ferromagnetic material.

The impulse detector consists of a coil wound onto a ferromagnetic core and, through an amplifier, controls a yarn cutter arranged upstream of the yarn feeding cylinder. The traveler, which is kept rotating by the winding of the yarn and is slightly magnetized by the permanet magnet, induces dynamic electromotive power impulses in the coil of the impulse detector. In the event of a yarn break, the traveler stops in any position of the ring and, simultaneously, the induced voltage impulses within the coil stop.

The presence or absence of these impulses, adequately amplified and processed, makes it possible to signal the breakage of the yarn and/or to operate the yarn cutting device.

The device according to this invention makes it possible to detect a yarn break in any position of the run of the yarn including the rewinding section, insofar as the detecting member is arranged within the traveler supporting ring. Moreover, since it has no additional members in contact with the yarn, any possible influence on the yarn is totally excluded. Finally, since the device in question consists essentially of an electromagnetic apparatus, it can be applied to any type of drawing frame equipped with cops, without introducing any mechanical modifications.

The constructional and functional characteristics of the break detecting device, which is the object of this invention, can be still better understood from the following description in which reference is made to the attached FIGURE representing schematically a perspective view of an embodiment of the devicein question, given by way of non-limiting example.

With reference to the numbers appearing in the FIGURE, the yarn break detecting device comprises a permanent magnet 1 fixed onto the ring support 2 and an electromagnetic impulse detector 4 consisting of a coil wound on a ferromagnetic core and fixed on the ring support 2 close to the passage of the traveler 5.

The traveler 5, which is made at least partially of a ferromagnetic material, is kept rotating by the yarn 6, which is being wound on the cop 7 and is slightly magnetized by the permanent magnet 1. As a result of said magnetization, the traveler which passes close to the detecting device 4 induces dynamic electromotive power impulses in the coil of the detecting device. These impulses are amplified by the amplifier 8 and transmitted to a yarn-cutting device 9 arranged upstream of the feeding cylinders 10 and 10' and of the stretching wheel 11. Moreover, beforebeing passed through the traveler 5, the yarn 6 is led through the yarn guide 12 positioned above the cop 7 and before the stretching wheel 11.

In the event of a break in the yarn 6, the traveler 5 stops in any position of the ring 3 and consequently no longer induces electromotive power impulses in the coil of the detecting device 4. The absence of such impulses actuates the operation of the yarn-cutting device 9 which cuts the yarn upstream of the feeding rollers 10 and 10'; the accumulation of the thick skeins of yarn around the stretching wheel 11 is thus avoided, eliminating therefore any resulting mechanical damage to the textile machine.

The foregoing clearly shows the flexibility of the yarn breakage detecting device according to this invention, due to its simple construction and functionality.

What is claimed is:

1. In combination with a textile machine having a ring support, yarn feeding cylinders and a yarn cutting device positioned upstream of said yarn feeding cylinders, a device for detecting yarn breaks in drawing and spinning frames comprising:

a permanent magnet attached to said ring support, a traveler made at least partially of a ferromagnetic material positioned adjacent said permanent magnet, said traveler being rotated by the winding of said yarn and slightly magnetized by said permanent magnet, an electromagnetic impulse detector having a coil wound on a ferromagnetic core attached to said ring support adjacent said traveler, a voltage being induced in said coil by said magnetized traveler as it is moved past said detector, and an amplifier coupling said electromagnetic impulse detector to said yarn cutting device, operation of said yarn cutting device being prevented when said impulse detector receives pulses as a result of the movement of said magnetized traveler by said yarn, and said yarn cutting device being actuated to cut said yarn when a break in the yarn causes said traveler to stop moving and pulses are no longer received by said impulse detector.

* * * * *